United States Patent [19]

Vincinguerra

[11] Patent Number: 4,828,126

[45] Date of Patent: May 9, 1989

[54] BABY BOTTLE HAVING AN AIR INLET VALVE

[76] Inventor: Mark T. Vincinguerra, 51 E. 23rd St., Riviera Beach, Fla. 33403

[21] Appl. No.: 97,942

[22] Filed: Sep. 17, 1987

Related U.S. Application Data

[63] Continuation-in-part of Ser. No. 63,071, Jun. 17, 1987, Pat. No. 4,730,744.

[51] Int. Cl.[4] ..... A61J 9/04

[52] U.S. Cl. ..... 215/11.5; 215/11.1; 137/903

[58] Field of Search ..... 215/11.1, 11.4, 11.5; 251/320, 321, 336, 337; 137/540–542, 903

[56] References Cited

U.S. PATENT DOCUMENTS

| | | | |
|---|---|---|---|
| 297,174 | 4/1884 | Seymour | 215/11.5 X |
| 362,554 | 5/1887 | Suydam . | |
| 1,037,309 | 9/1912 | Poore . | |
| 1,156,872 | 10/1915 | Atwood | 137/540 X |
| 1,510,571 | 10/1924 | Ware . | |
| 1,694,754 | 12/1928 | Porter | 215/11.4 X |
| 1,732,126 | 10/1929 | Gardner | 215/11.5 |
| 1,774,690 | 9/1930 | Willoughby | 137/541 |
| 1,930,040 | 10/1933 | Crowley | 137/903 X |
| 2,084,099 | 6/1937 | Maccoy | 215/11.5 X |
| 2,094,721 | 10/1937 | Puetz . | |
| 2,321,236 | 6/1943 | Parkin | 215/11.1 X |
| 2,390,861 | 12/1945 | Younkins | 215/11.5 |
| 2,616,581 | 11/1952 | Madsen et al. . | |
| 2,669,234 | 2/1954 | Baracate | 215/11.4 |
| 2,753,068 | 7/1956 | Robinson | 215/11.4 |
| 2,825,479 | 3/1958 | Litzie | 215/11.5 |
| 3,043,462 | 7/1962 | Brill, Jr. et al. | 215/11.1 |
| 3,134,495 | 5/1964 | Carbonel | 215/11.5 |
| 3,200,980 | 8/1965 | Jamell | 215/11.5 |
| 3,292,808 | 12/1966 | Greene | 215/11.5 |
| 3,355,047 | 11/1967 | DeSole | 215/11.1 |
| 3,511,407 | 5/1970 | Palma | 215/11.1 X |
| 3,768,682 | 10/1973 | Meyers et al. | 215/11.5 |
| 3,768,683 | 10/1973 | Van Den Bosch | 215/11.5 |
| 4,401,224 | 8/1983 | Alonso | 215/11.5 |
| 4,545,491 | 10/1985 | Bisgaard et al. | 215/11.5 |
| 4,685,577 | 8/1987 | Chen . | |

FOREIGN PATENT DOCUMENTS

| | | | |
|---|---|---|---|
| 2944279 | 5/1981 | Fed. Rep. of Germany | 215/11.5 |
| 121271 | 7/1927 | Switzerland | 215/11.5 |
| 2139903 | 11/1984 | United Kingdom | 215/11.1 |

*Primary Examiner*—Sue A. Weaver

*Attorney, Agent, or Firm*—Foley & Lardner, Schwartz, Jeffery, Schwaab, Mack, Blumenthal & Evans

[57] ABSTRACT

The baby bottle according to the invention has identically threaded openings in each end to accept interchangeable screw-on fixtures. One fixture contains a nipple and the second fixture contains a spring-loaded valve. The valve includes a central channel connected to air channels for supplying air to the base of the bottle. The valve is recessed into the bottle to avoid inadvertent opening or breakage when the valve is dropped.

16 Claims, 2 Drawing Sheets

BABY BOTTLE HAVING AN AIR INLET VALVE

CROSS REFERENCE

The present application is a continuation in part of application Ser. No. 063,071 which was filed on June 17, 1987, U.S. Pat. No. 4,730,744, and is incorporated herein by reference.

BACKGROUND OF THE INVENTION

1. Field of the Invention

The invention relates to a baby bottle, and more particularly to a baby bottle having valve means in the bottom to admit air, the value being removable to facilitate cleaning the bottle.

2. Related Art

Conventional baby bottles have a major disadvantage in that as the baby sucks on the bottle, the nipple collapses. Thus, the infant must periodically release the hold on the nipple to permit air to re-enter the bottle.

It has been recognized that it is desirable to permit air to enter the baby bottle from a valve mechanism. Examples of such prior art devices are found in U.S. Pat. Nos. 1,694,754; 2,669,234; 2,825,479; 3,768,683; 4,401,224; and 4,545,491. The patent appearing to be the closest prior art in appearance, U.S. Pat. No. 3,768,683, has a solid mushroom-shaped valve with the seal thereon. It has the distinct disadvantage in that it will not seat well and will wobble unless the tolerance is so close that the cost would be prohibitive.

SUMMARY OF THE INVENTION

It is therefore an object of the present invention to provide a baby bottle with a valve means which will prevent the nipple from collapsing and reduce the chance of the infant developing colic due to excess air intake.

Another object is to provide a simple valve mechanism which will permit air to enter the bottom of the baby bottle and reduce the chance of leakage around the air intake valve.

Still another object is to recess the valve so that it will not be hit if the bottle falls or is dropped.

A further object is to provide a removable valve to facilitate cleaning of the bottle.

Yet another object is to simplify assembly by providing interchangeability between the end containing the nipple and the end containing the valve.

The baby bottle according to the invention is symmetric about its center with threaded openings at each end. A nipple mounted in a fixture is screwed onto one end of the bottle and a valve recessed in a fixture is screwed onto the bottle's opposite end. The valve has a resilient collar around a spindle which acts as a spring. The valve has a seal and includes channels to form air inlets.

BRIEF DESCRIPTION OF THE DRAWINGS

The above and other objects will be better appreciated from the following description, together with the accompanying drawings wherein.

DETAILED DESCRIPTION OF THE PREFERRED EMBODIMENTS

Figure 1:
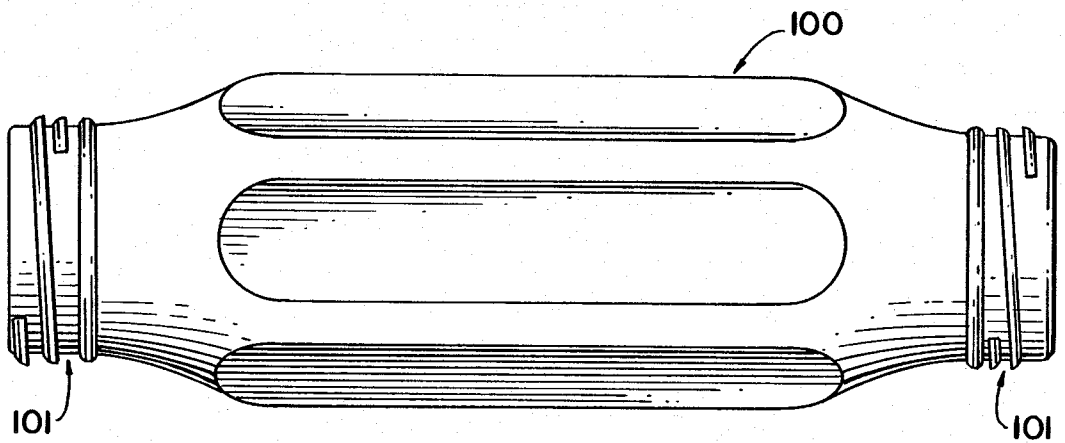
FIG. 1 is a side view of the bottle without the valve or nipple.
Figure 2:
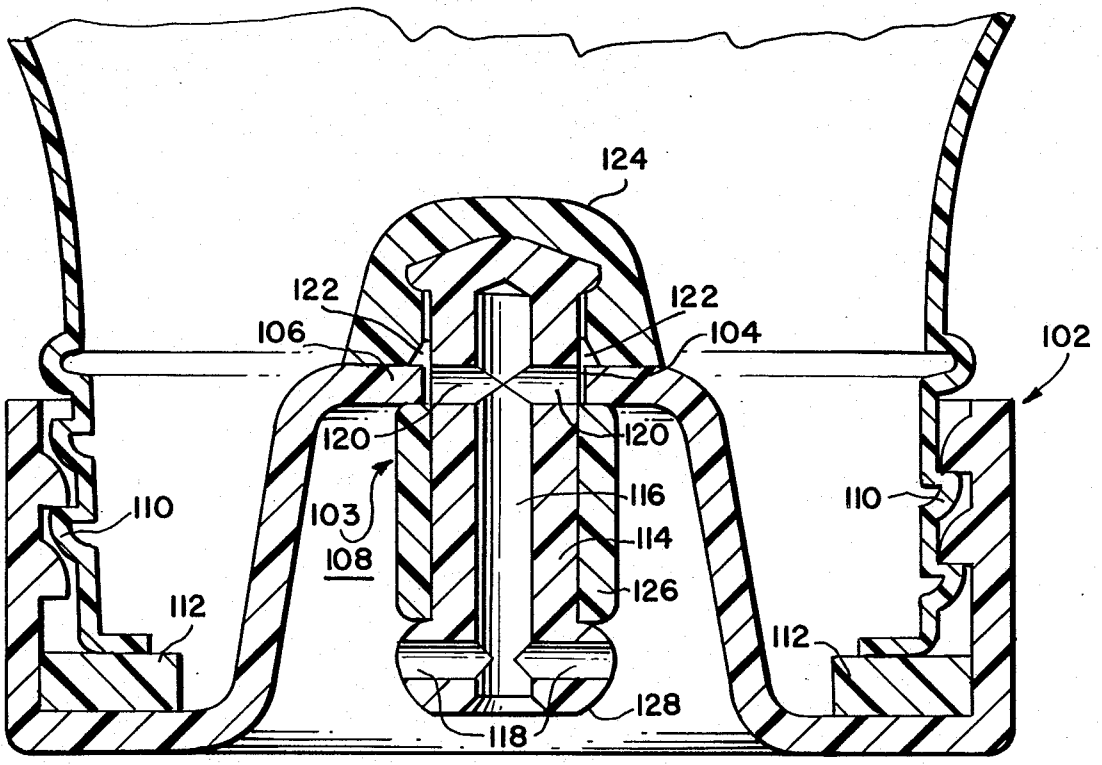
FIG. 2 is a cross-sectional view of the valve mounted in a fixture screwed to one end of the bottle.

Referring to the drawings, a bottle 100 has two identically threaded openings 101 at opposite ends for accepting screw-on fixtures. A nipple (not shown) is connected to one end of the bottle in a conventional manner by a screw top. A screw-on fixture 102 containing a valve 103 is connected to the opposite end of the bottle, allowing part of the valve to extend into the interior of the bottle.

The valve 103 is mounted through a hole 104 in a flat wall 106 in a recessed portion 108 of the screw on fixture 102 between its threaded ends 110. An O-ring seal 112 in the screw-on fixture 102 prevents leakage from the bottle through the fixture.

The valve has a valve stem or body 114 with a central cylindrical channel 116 extending through the wall 106 in the recessed portion of the screw-on fixture to the portion 108 of the valve inside the bottle. A plurality of lower air inlet channels 118 and upper air inlet channels 120 are connected to the central cylindrical channel 116. The air inlets 120 cooperate with a bevelled portion 122 on a dome-shaped seal 124 to direct air into the bottle from the channel 116. Seal opens and closes the air inlets 120, supplying air to the bottle. A resilient collar 126 acts as a spring to control operation of the valve. A finger press 128 allows manual operation of the valve.

In operation, the fixture mounted valve 102, 103 is screwed on one end of the bottle, the bottle is filled with liquid and the nipple is connected to the opposite end of the bottle. The resilient collar 126 of the valve can be configured such that negative sucking pressure overcomes the resilient spring action. Thus, when an infant begins sucking on the nipple, the resilient collar forces seal 124 toward the interior of the bottle and opens air inlets 120. Alternatively, a person holding the bottle can depress finger press 128 permitting the air inlets 120, to open. To facilitate cleaning of the bottle the fixtures containing the nipple and the valve can be removed.

While one embodiment of the invention has been described, it will be understood that it is capable of further modifications, and this application is intended to cover any variations, uses or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

What is claimed is:

1. A bottle for feeding a baby comprising:

(a) a pair of ends, (b) a threaded opening on each of the ends, each of openings being threaded identically to accept interchangeable screw-on fixtures, (c) a first screw-on fixture containing a nipple and connected to one of the openings, (d) a second screw-on fixture connected to the other opening, said fixture having at least one wall with a hole therein, the hole receiving a valve, the valve having open and closed positions and comprising:

(1) a body having a first portion extending through the hole into the interior of the bottle and a second portion extending exterior to the bottle, (2) air inlet means extending through the body, (3) seal means surrounding the first portion cooperating with the first portion and the hole, and (4) resilient collar spring means surrounding an upper part of the second portion for urging the seal means toward the wall to close the air inlet means.

2. The bottle as defined in claim 1 further comprising an O-ring between the second fixture and the bottle.

3. The bottle as defined in claim 1 wherein the resilient collar has first and second ends, the first end of the collar contacting the wall and the second end of the collar contacting a lower part of the second portion of the body and wherein the air inlet means comprises:

(a) a central channel extending through the first and second portions of the body, an upper part of the second portion of the body being surrounded by the resilient collar, (b) air inlets in the second portion of the valve, the air inlets connected perpendicularly to the central channel, and disposed in the lower part of the second portion of the body, (c) air inlets in the first portion of the valve being disposed substantially adjacent to the wall, the air inlets connected perpendicularly to said central channel.

4. The bottle as defined in claim 1 wherein said resilient collar spring means has a tension force equal to slightly less than the normal sucking force of an infant.

5. The bottle as defined in claim 1 further comprising a finger press for manually compressing the spring means to open the valve.

6. The bottle as defined in claim 1 wherein the wall extends into the bottle to provide a recess for the valve.

7. The bottle as defined in claim 1 wherein the seal means is dome-shaped.

8. The bottle as defined in claim 7 wherein the seal means has a beveled portion adjacent a portion of the inlet means.

9. The bottle defined in claim 1 wherein the bottle is symmetrically shaped.

10. A bottle for feeding a baby comprising:

(a) an opening in an end having a wall extending across the end, (b) a hole in the wall with a valve body therein, (c) the body having a first portion extending through the hole into the interior of the bottle and a second portion extending exterior to the bottle, (d) air inlet means extending through the body, (e) seal means surrounding the first portion and cooperating with the first portion and the hole, and (f) spring means in the form of a resilient collar surrounding an upper part of the second portion for urging the seal means toward the wall to close the air inlet means.

11. The bottle as defined in claim 10 wherein the resilient collar has first and second ends, the first end of the collar contacting the wall and the second end of the collar contacting a lower part of the second portion of the body, and wherein the air inlet means comprises:

(a) a central channel extending through the first and second portions of the body, an upper part of the second portion of the body being surrounded by the resilient collar, (b) air inlets in the second portion of the valve, the air inlets connected perpendicularly to the central channel and disposed in the lower part of the second portion of the body, (c) air inlets in the first portion of the valve being disposed substantially adjacent the wall, the air inlets connected perpendicularly to said central channel.

12. The bottle as defined in claim 10 wherein said spring means has a tension force equal to slightly less than the normal sucking force of an infant.

13. The bottle as defined in claim 10 further comprising a finger press for manually compressing the spring means to open the valve.

14. The bottle as defined in claim 10 wherein the wall extends into the bottle to provide a recess for the valve.

15. The bottle as defined in claim 10 wherein the seal means is dome-shaped.

16. The bottle as defined in claim 15 wherein the seal means has a beveled portion adjacent a portion of the inlet means.

* * * * *